United States Patent [19]

Matsuoka

[11] 4,424,023

[45] Jan. 3, 1984

[54] METHOD AND APPARATUS FOR TEMPERATURE CONTROL IN HEATING FURNACES

[75] Inventor: Toshio Matsuoka, Niihama, Japan

[73] Assignee: Sumitomo Heavy Industries, Ltd., Tokyo, Japan

[21] Appl. No.: 354,428

[22] Filed: Mar. 3, 1982

[30] Foreign Application Priority Data

Mar. 9, 1981 [JP] Japan ..... 56-33615

[51] Int. Cl.[3] ..... F27D 7/00; F27B 1/26

[52] U.S. Cl. ..... 432/19; 432/20; 432/36

[58] Field of Search ..... 432/19, 20, 24, 36, 432/37; 236/15 BD

[56] References Cited

U.S. PATENT DOCUMENTS 2,308,902 1/1943 Weller ..... 432/20

3,969,068 7/1976 Miller et al. ..... 432/20

*Primary Examiner*—John J. Camby

*Attorney, Agent, or Firm*—Flynn, Thiel, Boutell & Tanis

[57] ABSTRACT

A method is disclosed for temperature control in a heating furnace including a step of regulating the emissivity of the flame in the heating furnace. This regulation is accomplished by adjusting the soot content of the flame. The soot content is changed by introducing auxiliary gaseous fuel, i.e., hydrocarbonaceous material, in addition to the main gaseous fuel, into the heating furnace. A heating furnace temperature control apparatus for carrying out this method is also disclosed.

13 Claims, 5 Drawing Figures

METHOD AND APPARATUS FOR TEMPERATURE CONTROL IN HEATING FURNACES

This invention relates to a method and an apparatus for controlling the temperature in heating furnaces.

Conventional heating furnaces employ large quantities of refractory materials and heat insulating members that have a high thermal capacity, thereby making it difficult, in many cases, to regulate the internal temperature of the furnace, in accordance with a predetermined pattern, merely by controlling the amount of fuel that is burned. The reason for this is that a change in the quantity of the radiation heat, through convection heat transfer, cannot sufficiently be anticipated on the basis of a change in the volume of the combustion gas.

Combustion control is effective in a case where the volume of the combustion gas can be changed by regulating the combustion volume, or where the size of the flame can be regulated, as in a large convection heat transfer area found in a boiler or the like. However, control of the temperature of the material which is to be heated in a heating furnace cannot be accomplished by changing the volume of the combustion gas.

In such heating furnaces, it is commonly the case that the contribution of convection heat transfer is small because of the small heating surface of the material being heated and because the heat duty per furnace volume is so large that there is insufficient volume to effect temperature control by changing the flame size.

SUMMARY OF THE INVENTION

The present invention has been provided in the light of the above-described circumstances. An object of the present invention is to provide a method for easily controlling the temperature in a heating furnace and an apparatus for practicing said method. According to the present invention, the foregoing object is attained by providing a temperature control method which comprises the step of controlling the emissivity of the flame in the heating furnace so as to vary the quantity of heat transferred to the material being heated, whereby the temperature of said material can be adjusted with ease.

Further, the foregoing object is attained by providing a temperature control apparatus which comprises an introduction line for the main gas fuel, an introduction line for introducing the air used for combustion of the main gas fuel, an auxiliary introduction line for an auxiliary gas fuel, a line for introducing auxiliary air used for combustion of the auxiliary gas fuel, a temperature sensor having a temperature sensing part which is inserted within the body of the heating furnace, ratio setting means for regulating the volumetric ratio of auxiliary air to auxiliary gas fuel introduced into the furnace and operable in response to the temperature detected by said temperature sensor, a feed control valve for the auxiliary gas fuel and operable in response to a signal produced by the ratio setting means, and a feed control valve for the auxiliary combustion air to be mixed with the auxiliary gas fuel, also responsive to a signal produced by the ratio setting means.

The invention, both as to its organization and method of operation, together with further objects and advantages thereof, may best be understood by reference to the following description taken in connection with the accompanying drawings, in which.

DESCRIPTION OF THE PREFERRED EMBODIMENT

Figure 1:
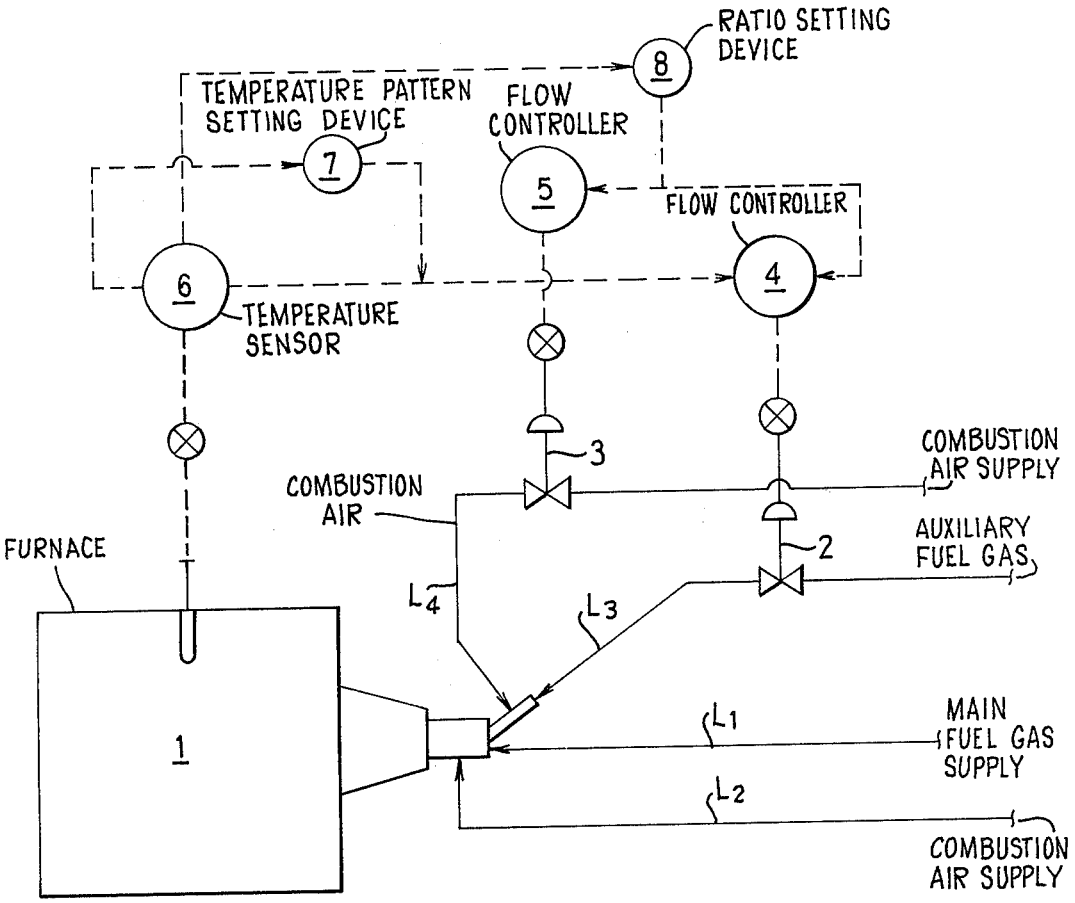
FIG. 1 is a diagrammatic view of the temperature control apparatus for practicing temperature control according to the present invention.

Referring first to FIG. 1, there is shown a heating furnace 1 to which is connected a main fuel gas introduction line $L_1$, a combustion air introduction line $L_2$ for mixing combustion air with the main fuel gas supplied through line $L_1$, an auxiliary fuel gas introduction line $L_3$ and a combustion air introduction line $L_4$ for mixing combustion air with the auxiliary fuel gas supplied through line $L_3$.

The lines $L_3$ and $L_4$ are provided with control valves 2 and 3, respectively, which in turn are connected to flow controllers 4 and 5, respectively, for operating the respective control valves.

A temperature sensor 6, such as a thermocouple, is provided on the upper side of the heating furnace 1 with its temperature sensing portion being inserted within the furnace. The temperature sensor 6 produces a signal indicative of the internal temperature of the heating furnace, and transmits the signal to the flow controller 4, and to a temperature pattern setting device 7 and to a ratio setting device 8 for setting the ratio of the amount of auxiliary fuel gas to the amount of combustion air therefor.

The main fuel gas supplied through line $L_1$ is selected from fuel gases having a relatively high hydrogen-carbon atomic ratio (H/C) like those of alkane-typed fuel gases, such as natural gas, propane gas, coke oven gas or butane. By contrast, the auxiliary fuel gas supplied through line $L_3$ is selected from gases which have a relatively low hydrogen-carbon ratio like those of alkene- and alkyne-type fuel gases, such as acetylene.

Generally, in a heating furnace in which a gaseous fuel is employed, the emissivity of the flame is low due to the transparency of the flame, so that the temperature of the materials being heated therein has a tendency not to rise at all even when there is a major increase in the exhaust gas temperature.

It is known that the emissivity of such a flame greatly increases when only a very slightly amount of soot, on the order of 200 ppm, is present in the flame. Therefore, according to the present invention, the temperature of the material being heated is controlled and adjusted by varying the emissivity of the flame, thereby changing the amount of radiant heat transfer to the material being heated. Incomplete burning of a hydrocarbon fuel increases the content of soot (carbon black) in the flame, thereby increasing the emissivity of the flame, as discussed below.

The methods of heat control, according to the present invention, can be enumerated as follows.

(1) The simplest method, according to the invention, is to produce soot in the flame by altering the amount of air fed through the line $L_2$ for effecting combustion of the main fuel gas, so that all or part of the flame slightly lacks sufficient air for complete combustion whereby soot is produced.

(2) According to a second method of the invention, the auxiliary fuel gas supplied through line $L_3$ and the combustion air therefor supplied through line $L_4$ are controlled, by means of the flow controllers 4 and 5 and the control valves 2 and 3, in response to the sensing signal generated by the temperature sensor 6 and which is transmitted to the ratio setting device 8. In this case, the combustion air to be mixed with the auxiliary fuel gas is adjusted to be an amount insufficient for effecting complete combustion of the auxiliary fuel gas in accordance with the particular need. The combustion air for the main fuel gas is regulated to be an amount which is approximately stoichiometrically equivalent to the main fuel gas such that substantially complete combustion of the main fuel gas will occur.

(3) According to a third method of the invention, the amount of the auxiliary fuel gas fed in through line $L_3$ is increased or decreased without making any adjustment of the amount of the auxiliary air fed in through line $L_4$. This method is similar to that of (2) above in other respects. A relative increase in the amount of auxiliary fuel gas will have approximately the same effect as a corresponding decrease in the auxiliary air content.

(4) According to a fourth method of the invention, the amount of auxiliary air fed in through line $L_4$ is reduced when it is desired to increase the amount of heat, without varying the amount of auxiliary fuel gas fed in. This expedient increases the amount of soot in the flame whereby effectively to increase the quantity of heat transmitted to the material being heated. The increased soot is produced by the incomplete combustion of the auxiliary gas due to the decrease in the amount of auxiliary air for combustion.

In methods (2) through (4) above, the temperature not only can be held at a constant desired level, but also it can be adjusted up and down whereby to follow a predetermined heating pattern in response to operation of the pattern setting device 7.

Figure 2:
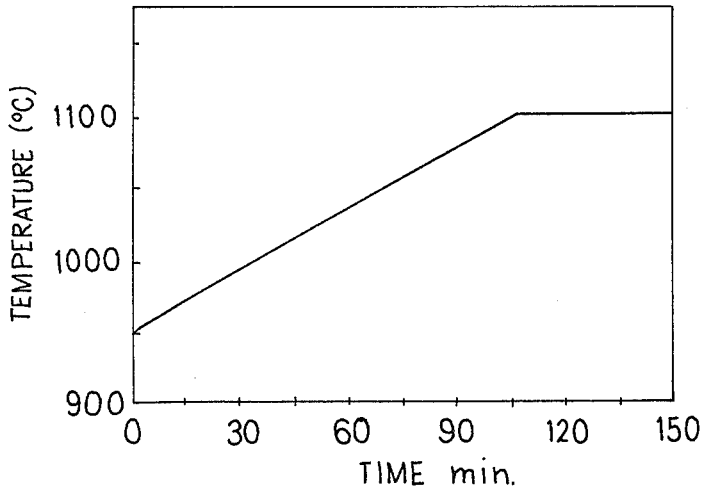
FIG. 2 is a graph showing a theoretical temperature control curve.
Figure 3:
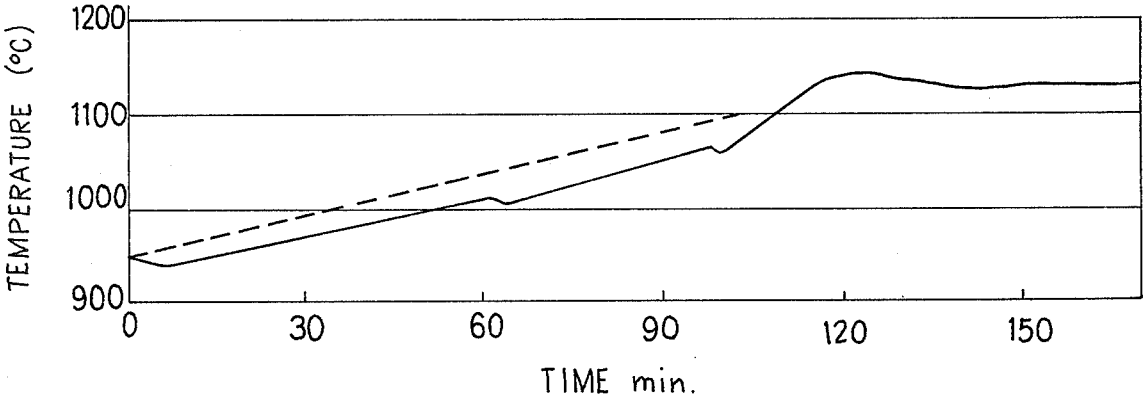
FIG. 3 is a graph showing the actual temperature control curve.

FIG. 2 shows the theoretical heat control curve and FIG. 3 depicts the actual control curve achieved by manual operation in a case in which $C_3H_8$ is employed as the main fuel gas supplied through line $L_1$ and $C_2H_2$ is used as the auxiliary fuel gas supplied through line $L_3$.

Figure 4:
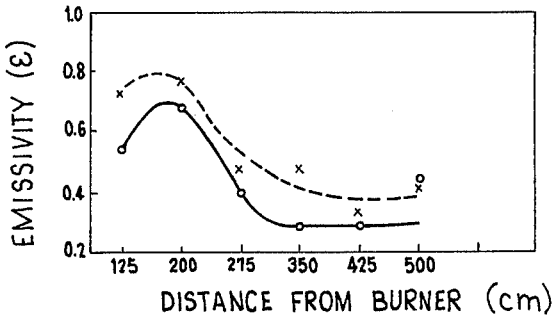
FIGS. 4 and 5 are graphs depicting the improvement in flame emissivity when carbon black is mixed with the fuel.
Figure 5:
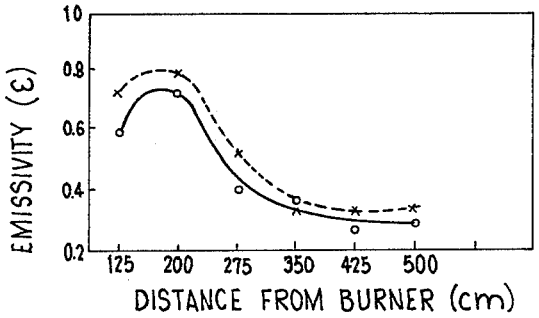

FIG. 4 and FIG. 5, reproduced from Hubbard, *The Effect on Flame Emissivity and Radiation of the Addition of Carbon Black to Liquid Fuels,* Journal of the Institute of Fuel (page 340, FIGS. 2*d* and 3*d*), July 1956, illustrate the difference between the emissivity of normal fuel and that of a fuel to which carbon black has been added. In both drawings the dotted line shows the case in which the carbon black content is increased by adding carbon black to the fuel.

FIG. 4 shows a case wherein light gas oil having a C/H ratio of 6.47 and light gas oil containing carbon black having a C/H ratio of 7.66 were employed. FIG. 5 shows a case wherein heavy fuel oil having a C/H ratio of 7.25 and heavy fuel oil containing carbon black having a C/H ratio of 7.74 were employed. As is apparent from these graphs, the radiation rate or emissivity of the flame can be increased by increasing the carbon black content in the fuel.

As described above, the temperature control method according to the present invention increases the amount of carbon in the flame to produce soot, whereby the emissivity of the flame is varied and thereby the quantity of heat that is transmitted to the material to be heated is changed. Thus, temperature control is achieved very easily. Moreover, the temperature control apparatus has a simple construction as described above, so that temperature control can be executed through a comparatively simple arrangement.

What is claimed is:

1. A method for controlling the temperature of a charge of material disposed in a heating furnace, which comprises: heating said charge of material by radiant heat emitted from a flame generated by combustion of fuel gas in said heating furnace; varying the degree of completeness of combustion of said fuel gas so as to alter the soot content of said flame, to thereby change the emissivity of said flame and thereby modify the amount of radiant heat transferred to said charge of material, the amount of said soot in said flame being increased in order to increase said flame emissivity and thereby increase the radiant heat transferred to said charge of material, and the amount of said soot in said flame being decreased in order to decrease said flame emissivity and thereby decrease the radiant heat transferred to said charge of material.

2. A method as set forth in claim 1, further comprising the steps of introducing fuel gas and an oxygen-containing combustion gas for burning said fuel gas simultaneously and continuously into said furnace to produce said flame, the amount of said combustion gas being less than the amount required to effect complete combustion of said fuel gas, whereby all or part of said flame lacks sufficient oxygen for complete combustion of said fuel gas and said soot is thereby produced; and varying the ratio of the amount of fuel gas to the amount of said combustion gas in order to adjust the amount of soot in said flame.

3. A method as set forth in claim 2, wherein said fuel gas comprises a main fuel gas and an auxiliary fuel gas, the amount of said auxiliary fuel gas fed into said furnace being controllable separately from the amount of said main fuel gas fed into said furnace, comprising the step of varying the amount of said auxiliary gas fed into said furnace in order to vary said soot content.

4. A method as set forth in claim 3, wherein said auxiliary fuel gas consists essentially of a hydrocarbonaceous material having an H/C ratio of total hydrogen atoms to total carbon atoms per molecule of said hydrocarbonaceous material lower than the corresponding H/C ratio of said main fuel gas.

5. A method as set forth in claim 2, wherein said fuel gas comprises a main fuel gas and an auxiliary fuel gas, and said oxygen-containing combustion gas comprises a main combustion gas for burning said main fuel gas and an auxiliary combustion gas for burning said auxiliary fuel gas, said main combustion gas, said main fuel gas, said auxiliary combustion gas and said auxiliary fuel gas being fed to a common burner for generating said flame by burning said main and auxiliary fuel gas, wherein the amount of said main combustion gas introduced into said burner is stoichiometrically equivalent to the amount thereof required to cause complete combustion of the amount of said main fuel gas introduced into said burner, further comprising the step of altering the ratio of the amounts of said auxiliary combustion gas to said auxiliary fuel gas to vary said soot content of said flame.

6. A method as set forth in claim 5, wherein said auxiliary fuel gas consists essentially of a hydrocarbonaceous material having an H/C ratio of total hydrogen atoms to total carbon atoms per molecule of said hydrocarbonaceous material lower than the corresponding H/C ratio of said main fuel gas.

7. A method as set forth in claim 5, in which the amount of said auxiliary combustion gas is decreased in order to increase said soot content and thereby increase the temperature of said charge of material, and the amount of said auxiliary combustion gas is increased in order to decrease said soot content and thereby decrease the temperature of said charge of material.

8. A method as set forth in claim 5, in which the amount of said auxiliary fuel gas is increased in order to increase said soot content and thereby increase the temperature of said charge of material, and the amount of said auxiliary fuel gas is decreased in order to decrease the said soot content and thereby decrease the temperature of said charge of material.

9. A method as set forth in claim 4, wherein said hydrocarbonaceous material of said auxiliary fuel gas is selected from the group consisting of alkenes, alkynes, and mixtures thereof.

10. A method as set forth in claim 6, wherein said hydrocarbonaceous material of said auxiliary fuel gas is selected from the group consisting of alkenes, alkynes, and mixtures thereof.

11. A method of controlling the temperature in a heating furnace in which a flame is generated by combustion of fuel gas, which comprises: varying the emissivity of said flame in said heating furnace to vary the amount of radiant heat transferred to a material to be heated in said furnace, wherein the emissivity of the flame in said heating furnace is varied by adjusting the amount of soot or carbon black in said flame, wherein the fuel for generating said flame comprises a first mixture comprising an auxiliary fuel gas and air, and a second mixture comprising a main fuel gas and air, wherein said auxiliary fuel gas consists of hydrocarbonaceous material whose H/C ratio of total hydrogen atoms to total carbon atoms per molecule of said hydrocarbonaceous material is lower than the corresponding H/C ratio of said main fuel gas, and the soot content of said flame is adjusted by changing the ratio of said auxiliary fuel gas to said air in said first mixture, the amount of said soot being increased in order to increase said flame emissivity and thereby increase the radiant heat transferred to said charge of material, and the amount of said soot being decreased in order to decrease said flame emissivity and thereby decrease the radiant heat transferred to said charge of material.

12. An apparatus for controlling the temperature in a heating furnace comprising a first introduction line for feeding a main fuel gas into said heating furnace; a second introduction line for supplying air for combustion and mixing it with said main fuel gas; a third introduction line for feeding an auxiliary fuel gas into said heating furnace; a fourth introduction line for supplying air for combustion and mixing it with said auxiliary fuel gas; a temperature sensor having temperature sensing means disposed within the body of said heating furnace, said sensor producing a signal indicative of the internal temperature of said heating furnace; ratio setting means operable in response to the temperature detected by said temperature sensor, said ratio setting means determining the ratio of said auxiliary fuel gas to the air for combustion to be mixed with said auxiliary fuel gas; a first regulating valve, said first valve regulating the amount of auxiliary fuel gas introduced into said heating furnace, said first valve being responsive to the signal produced by said ratio setting means; and a second regulating valve, said second valve regulating the amount of air for combustion to be mixed with said auxiliary fuel gas.

13. The apparatus as set forth in claim 12, further comprising heat pattern setting means responsive to the signal produced by said temperature sensor, connected to said first regulating valve and operable to control temperature in said furnace according to a predetermined pattern.

* * * * *